US009177764B1

(12) United States Patent
Baney

(10) Patent No.: US 9,177,764 B1
(45) Date of Patent: Nov. 3, 2015

(54) IMAGE INTENSIFIER HAVING AN ION BARRIER WITH CONDUCTIVE MATERIAL AND METHOD FOR MAKING THE SAME

(71) Applicant: EXELIS, INC., McLean, VA (US)

(72) Inventor: William J. Baney, Roanoke, VA (US)

(73) Assignee: Exelis, Inc., Herndon, VA (US)

( * ) Notice: Subject to any disclaimer, the term of this patent is extended or adjusted under 35 U.S.C. 154(b) by 0 days.

(21) Appl. No.: 14/076,371

(22) Filed: Nov. 11, 2013

(51) Int. Cl.
*H01J 43/04* (2006.01)
*H01J 9/14* (2006.01)

(52) U.S. Cl.
CPC .. *H01J 43/04* (2013.01); *H01J 9/14* (2013.01)

(58) Field of Classification Search
CPC ..... H01J 43/04; H01J 9/14
See application file for complete search history.

(56) References Cited

U.S. PATENT DOCUMENTS 3,603,832 A * 9/1971 Manley et al. ..... 313/528
3,609,433 A * 9/1971 Freedman ..... 313/526
3,660,668 A * 5/1972 Wolski ..... 250/214 VT
3,742,224 A * 6/1973 Einstein ..... 250/214 VT
3,777,201 A * 12/1973 Einstein ..... 313/526
4,051,403 A * 9/1977 Feingold et al. ..... 313/105 CM
5,495,141 A 2/1996 Thomas
5,510,673 A * 4/1996 Wodecki et al. ..... 313/524
6,040,000 A * 3/2000 Floryan et al. ..... 427/78
6,396,049 B1 * 5/2002 Estrera et al. ..... 250/214 VT
6,747,258 B2 * 6/2004 Benz et al. ..... 250/207
7,015,452 B2 * 3/2006 Benz et al. ..... 250/214 VT
8,786,168 B2 * 7/2014 Howorth ..... 313/103 CM
2003/0066951 A1 * 4/2003 Benz et al. ..... 250/214 VT
2005/0167575 A1 * 8/2005 Benz et al. ..... 250/214 VT
2006/0108923 A1 * 5/2006 Aoki et al. ..... 313/582
2011/0261239 A1 10/2011 Costello et al.
2013/0221828 A1 * 8/2013 Howorth ..... 313/103 CM
2014/0117249 A1 * 5/2014 Floryan ..... 250/398

* cited by examiner

*Primary Examiner* — Thomas A Hollweg
(74) *Attorney, Agent, or Firm* — RatnerPrestia

(57) ABSTRACT

An image intensifier tube includes a collimator having multiple channels for receiving electrons from a photocathode layer, and a microchannel plate (MCP) having multiple channels for receiving electrons from the collimator. An ion barrier film (IBF) is disposed on top of an input side of the MCP, in which the IBF includes a small amount of conductive material. The IBF may include alumina doped with chromium oxide, or manganese oxide, or any other conductive material. The small amount of conductive material includes 1% to 5% of conductive material in a layer of non-conductive material.

25 Claims, 3 Drawing Sheets

IMAGE INTENSIFIER HAVING AN ION BARRIER WITH CONDUCTIVE MATERIAL AND METHOD FOR MAKING THE SAME

FIELD OF THE INVENTION

The present invention relates, in general, to optical devices having image intensifier tubes. More specifically, the present invention relates to reducing the amount of low energy electrons in a dielectric film employed by such optical devices.

BACKGROUND OF THE INVENTION

An image intensifier ($I^2$) tube amplifies light to provide a visible image of a scene. Typically, the $I^2$ tube includes a photocathode (PC) behind the light-receiving face of the tube. The PC is responsive to photons of visible and infrared light to liberate photoelectrons. Because an image of a scene is focused on the PC, photoelectrons are liberated from the PC in a pattern which replicates the scene. These photoelectrons are moved by a prevailing electrostatic field to a microchannel plate having a multitude of microchannels. These microchannels have an interior surface at least in part defined by a material liberating secondary-emission electrons, when photoelectrons collide with the interior surfaces of the microchannels. In other words, each time an electron (whether a photoelectron or a secondary-emission electron previously emitted by the microchannel plate) collides with this material at the interior surfaces of the microchannels, more than one electron (i.e., secondary-emission electrons) leave the site of the collision.

As a consequence, the photoelectrons entering the microchannels cause a geometric cascade of secondary-emission electrons moving along the microchannels, from one face of the microchannel plate to the other face, so that a spatial output pattern of electrons issues from the microchannel plate. This pattern of electrons is moved from the microchannel plate to a phosphorescent screen electrode by another electrostatic field. When the electron shower from the microchannel plate impacts on and is absorbed by the phosphorescent screen electrode, visible-light phosphorescence occurs in a pattern which replicates the image. This visible-light image is passed out of the tube for viewing via a transparent image-output window.

It is estimated that about 20% of the electrons from the photocathode that impinge on the input surface of the MCP are scattered back toward the photocathode. The backscattered electrons are repelled by the electric field between the photocathode and the input surface of the MCP and forced to strike the input surface of the MCP a second time. This causes what is known as a halo effect, resulting in the electrons spreading out from the size of a small spot at the photocathode to the size of a much larger spot at the input surface of the MCP. A similar backscattered electron halo-generating effect also takes place at the phosphorescent screen.

In order to suppress this effect at the phosphorescent screen, a collimator is included in some image intensifier tubes. Such a collimator is disclosed in U.S. Pat. No. 5,495,141 and incorporated herein by reference. As described therein, a collimator is inserted between the output surface of the MCP and the phosphor screen. Some of the electrons entering the collimator strike the collimator walls and are prevented from reaching the phosphor screen. This phenomenon, however, reduces the number of electrons that get through the collimator to about 25% to 50% of the electrons leaving at the output of the MCP. This, in turn, results in a brightness loss for the image intensifier tube.

As will be explained, there are other problems resulting from attempts to reduce halo effects in image intensifier tubes. The present invention advantageously overcomes some of these problems and produces an image intensifier tube with reduced secondary emissions, reduced halo in the output image and reduced charge build-up that causes image burn-in and may damage the image intensifier tube.

SUMMARY OF THE INVENTION

To meet this and other needs, and in view of its purposes, the present invention provides an image intensifier tube having a collimator including multiple channels for receiving electrons from a photocathode layer, and a microchannel plate (MCP) including multiple channels for receiving electrons from the collimator. An ion barrier film (IBF) is disposed between the collimator and the MCP, and the IBF includes a small amount of conductive material.

The IBF includes alumina doped with chromium oxide, alumina doped with manganese oxide, or alumina doped with a conductive material. The amount of conductive material may be 1% to 5%.

The IBF may be disposed on top of the MCP, and may include approximately 98% of non-conductive material and approximately 2% of conductive material. Alternatively, a layer of conductive material may be deposited on top of the IBF.

Another embodiment of the present invention includes an imager comprising a microchannel plate (MCP) including multiple channels for receiving electrons from a photocathode layer, and an ion barrier film (IBF) disposed on top of the MCP. The IBF includes a small amount of conductive material. The IBF may include alumina doped with chromium oxide. The IBF may include alumina doped with manganese oxide. The IBF may include, in general, a small amount of conductive material, such as 1% to 5% of conductive material in a layer of alumina. The IBF may also include non-conductive material, and a layer of conductive material deposited on top of the IBF. The layer of conductive material may be 5 to 10 Angstroms in thickness.

Yet another embodiment of the present invention is a method of making a microchannel plate (MCP) for an image intensifier tube. The method comprises the steps of: (a) forming an ion barrier film (IBF) on top of an input side of the MCP; and (b) doping the IBF with 2% to 5% of conductive material. The step of forming may include forming the IBF with alumina, and the step of doping may include doping the IBF with chromium oxide. The step of forming may also include forming the IBF with alumina, and the step of doping may also include doping the IBF with manganese oxide.

In general, the step of forming may include forming the IBF with non-conductive material, and the step of doping may include doping the IBF with conductive material. As another process, the step of forming may include forming the IBF with non-conductive material, and the step of doping may include depositing a layer of conductive material 5 to 10 Angstroms in thickness on top of the IBF.

It is understood that the foregoing general description and the following detailed description are exemplary, but are not restrictive, of the invention.

BRIEF DESCRIPTION OF THE DRAWINGS

The invention may be best understood from the following detailed description when read in connection with the accompanying drawing. Included in the drawing are the following figures.

DETAILED DESCRIPTION OF THE INVENTION

The present invention provides an image intensifier tube including a photocathode at an input side, and a phosphor screen at an output side; in addition, a collimator and an MCP are inserted between the photocathode and the phosphor screen. The collimator is positioned following the photocathode; and the MCP is positioned following the photocathode and in front of the phosphor screen. Moreover, the input side of the MCP includes an ion barrier film (IBF) which has a small amount of conductive material such as chromium oxide.

Figure 1:
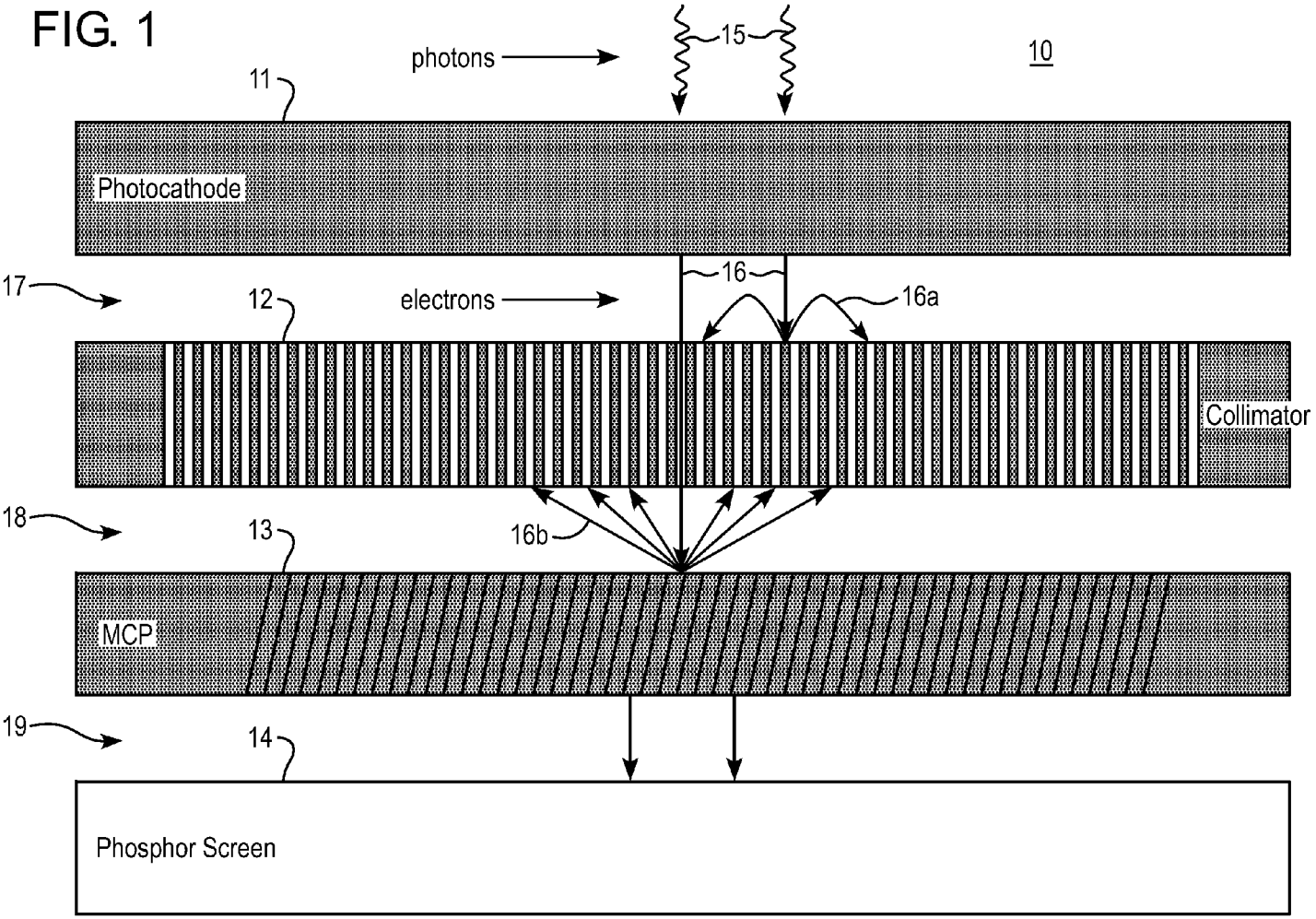
FIG. 1 is a schematic diagram of a cross section of a portion of an image intensifier tube that includes a collimator inserted between a photocathode and an MCP, in which the collimator captures backscattered electrons reflecting off the input side of the MCP.

Referring first to FIG. 1, an image intensifier tube, generally designated as 10, includes, in spatial sequence, photocathode 11, collimator 12, MCP 13 and phosphor screen 14. Photons 15 enter at the top of FIG. 1, penetrate a faceplate (not shown) and strike photocathode 11. Some of the photons 15 react with the photocathode to liberate electrons 16, which enter a vacuum space (gap) 17 between photocathode 11 and collimator 12. The electrons are accelerated toward collimator 12 by an electric field in gap 17 that is located between the photocathode and the collimator. Collimator 12 in this example is similar to the MCP. That is, it is comprised of a solid plate which is populated with a plurality of holes through which a portion of the electrons accelerated from the photocathode may pass and proceed to the MCP. Additionally, collimator 12 has metal contacts on both faces which serve as contacts. This metal also penetrates down each of the plurality of holes a pre-determined length. The portion of electrons which do not pass through the plurality of holes in the collimator will strike the surface of the collimator and will be backscattered toward the photocathode. The electric field in gap 17 redirects the electrons 16*a* back to the collimator via a parabolic path where a majority are captured by the end-spoiling metal at the input of the plurality of holes.

The electrons 16 propagate through the microchannels of collimator 12 and continue through gap 18 toward MCP 13. The MCP also includes microchannels which amplify the incoming electrons to provide a multiplied output of electrons toward phosphor screen 14. An electric field between the input side of collimator 12 and the output side of MCP 13 accelerates the electrons 16 as they are multiplied and, thereby, amplified. Although there is a potential difference between the input side of the collimator and the output side of the MCP, there is no potential difference between the output side of the collimator 12 and the input side of MCP 13. Thus, the portion of electrons 16 which do not enter the microchannels on MCP 13 but strike the surface, are backscattered from the input side of the MCP as electrons 16*b* are backscattered in a straight trajectory and captured by the collimator 12. The straight trajectory of electrons 16*b* is due to the electric field-free environment existing in gap 18.

Completing the description of FIG. 1, another gap, designated as 19, is disposed between the output side of MCP 13 and phosphor screen 14. The electrons 16 move from the MCP to the phosphor screen by another electrostatic field. The electrons 16 are absorbed by the phosphorescent screen electrode and become visible light for viewing via a transparent image output window (not shown).

Figure 2:
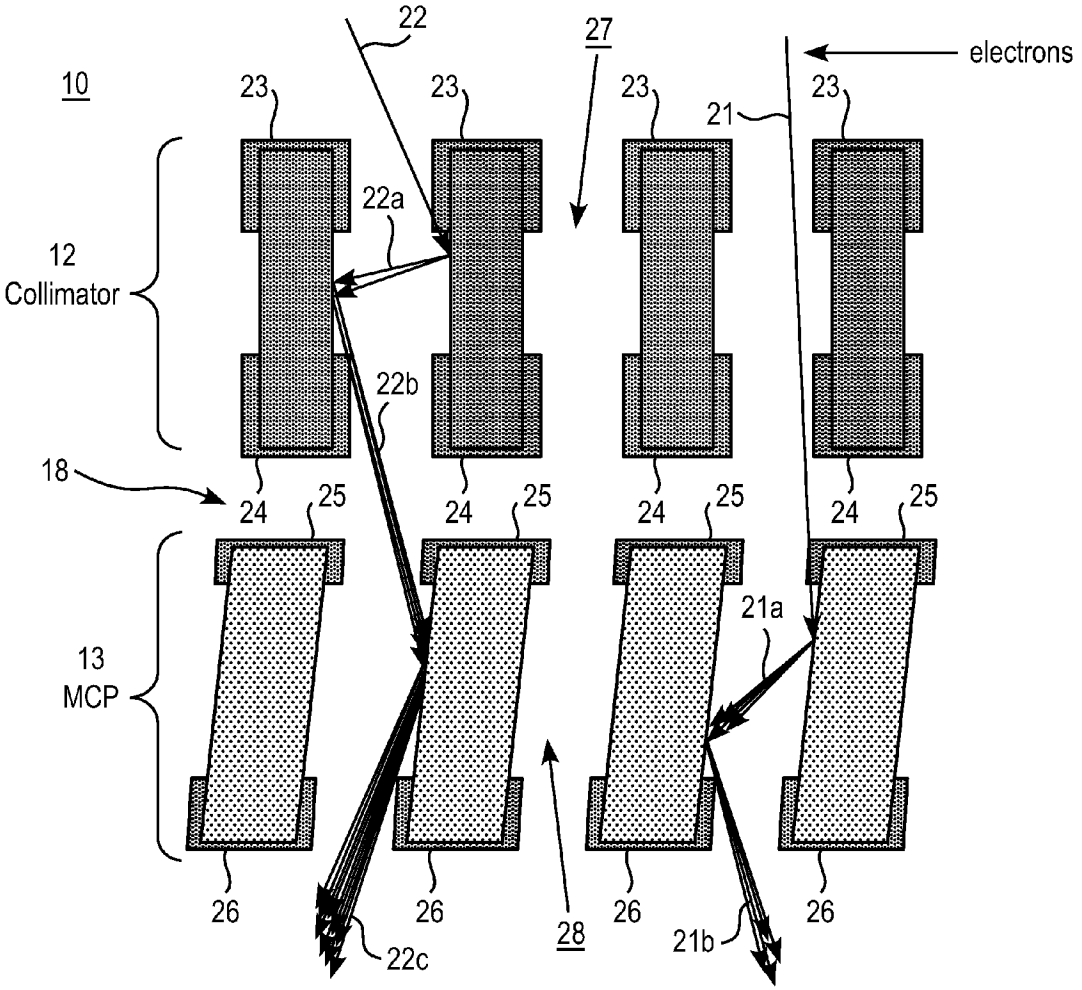
FIG. 2 is a diagram of an enlarged portion of the image intensifier tube shown in FIG. 1, in which the collimator is used as a source of gain for the incoming electrons arriving from the photocathode.

Turning next to FIG. 2, there is shown an expanded view of a portion of image intensifier 10. As shown, collimator 12 includes multiple channels 27 and MCP 13 includes multiple channels 28. Both collimator 12 and MCP 13 are formed by similar processes that are known in the art. The collimator and MCP include many tiny glass fibers which have a thin cladding glass surrounding each tiny glass fiber. The glass fibers are etched to form multiple channels 27, or multiple channels 28, with the thin cladding glass forming the walls of the multiple channels.

The upper and lower portions 23 and 24, respectively, of collimator 12 are deposited with a conductive material. Similarly, the upper and lower portions 25 and 26, respectively, of MCP 13 are deposited with a conductive material. In this manner, electrodes are established to permit an electric field gradient throughout the lengths of collimator 12 and MCP 13. While an electric field gradient exists between the input side of collimator 12 and the output side of MCP 13, there is no electric field gradient in gap 18, because the collimator output side and the MCP input side are connected together. A portion of the total voltage gradient is dropped across the collimator, based on a ratio of the collimator's resistance to the MCP's resistance.

Due to the electric field gradient between the input and output sides of the collimator, the multiple channels 27 are sources for electron gain. Thus, incoming electrons 22 are multiplied as they are reflected off the cladding walls of multiple channels 27. This multiplication phenomenon, or gain phenomenon is shown in FIG. 2 by the successive increase in outgoing electrons 22*a* and 22*b*, as compared to the incoming electrons 22. As shown, however, incoming electrons 21 are not reflected off the wall in channel 27. Therefore, no gain is realized between the incoming electrons 21 and outgoing electrons 21 in channel 27.

In a similar manner, due to the electric field gradient between the input and output sides of the MCP, the multiple channels 28 are sources for electron gain. Thus, incoming electrons 22*b* are multiplied as they are reflected off the cladding walls of multiple channels 28 providing output electrons 22*c*. Similarly, incoming electrons 21 reflect off the cladding wall of channel 28 as electrons 21*a*, which in turn reflect off the cladding wall as outgoing electrons 21*b*. It will be appreciated that multiplication or gain is achieved in all channels 28, unlike gain in only some channels 27 due to the electrons entering channels 28 at a greater angle than the electrons entering channels 27. As shown in FIG. 2, the channels in collimator 12 are not tilted with respect to a normal line cutting through each of the channels. The channels in MCP 13, on the other hand, are tilted with respect to a normal line cutting through each of the channels.

Figure 3:
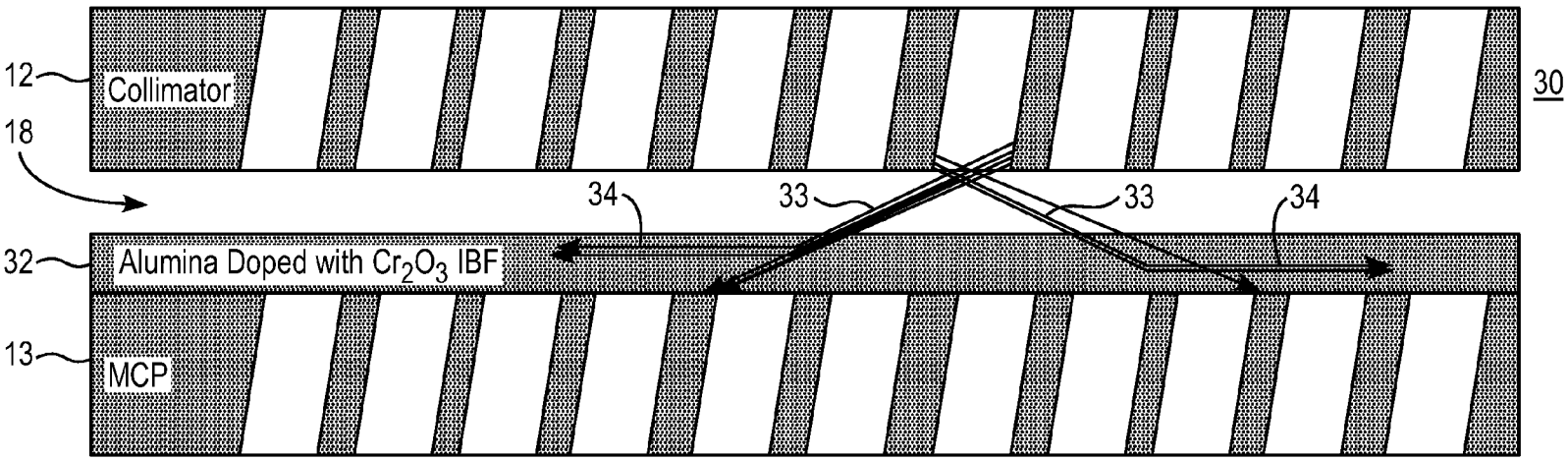
FIG. 3 is a diagram of an ion barrier film (IBF) deposited on top of the MCP that forms part of the image intensifier tube shown in FIG. 1. The IBF is doped with a conductive component such as $Cr_2O_3$.

Referring next to FIG. 3, image intensifier tube 30 includes a non-conductive alumina ion barrier film (IBF), generally designated as 32, which is deposited on, top of MCP 13. One reason for the IBF is to impede positive ions generated by electron strikes from traveling towards the cathode under the influence of the electric fields present in the tube and damaging its structure. The IBF, however, causes problems in the image intensifier tube. Since there is no potential difference between the output side of collimator 12 and the input side of MCP 13, there is no accelerating potential between the two sides. Consequently, those electrons which were created near the output of the collimator, and are the most numerous, have the lowest energy, and largest radial distribution and have no field to bend them from their original trajectory.

Higher energy electrons created further up the microchannels in collimator 12 spread less and have greater energy, and therefore are more likely to penetrate IBF 32. Impact with IBF 32 by the large spread of low energy electrons created near the end of the microchannels in collimator 12 have a much greater probability of becoming trapped in IBF 32. The low energy electrons that fail to penetrate IBF 32 can lead to a localized charge build-up in the film. The charge build-up creates noticeable, short term image retention as the electrons slowly disperse through the film.

The present invention fixes the problem of charge retention in the IBF by doping the IBF with a small amount of conductive material. For example, the conductive material may be approximately 2% chromium oxide ($Cr_2O_3$). The small amount of conductive material in the IBF causes the low energy electrons to readily disperse at a rapid pace, without adversely affecting the properties of the IBF. The effect of localized charge retention in the IBF, thus, is reduced. This is shown in FIG. 3 by low energy electrons 33 entering the IBF 32 and dispersing through the conductive material $Cr_2O_3$ as electrons 34.

It will be understood that other conductive material than $Cr_2O_3$ may be used in doping the IBF structure. For example, a small amount of $Mn_3O_4$ or similar metallic oxide may be used. The small amount of conductive material in the non-conductive alumina structure may vary, for instance, between 1% and 5%.

An alternative method for forming conductive contents in the IBF structure, without impacting the usefulness of the IBF structure, a thin layer of conductor material, such as aluminum, may be deposited on top of the alumina IBF. The thickness of the layer of conductive material may be approximately 5 to 10 Angstroms. The deposition method may include atomic layer deposition (ALD), electro-plating, chemical vapor deposition (CVD), physical vapor deposition (PVD) and the like, and any combinations thereof.

It will be understood that the aforementioned discussion of doped IBF also applies to a standard image intensifier tube which includes an MCP and photocathode, without a collimator sandwiched between them. The doped IBF may be applied to the image intensifier tube in instances where a low clamp voltage is desirable.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. An image intensifier tube comprising:

a collimator including multiple channels for receiving electrons from a photocathode layer;

a microchannel plate (MCP) having multiple channels for receiving electrons from the collimator; and an ion barrier film (IBF) disposed on top of and in contact with the MCP between the collimator and the MCP, wherein the IBF comprises non-conductive material and approximately 1% to 5% of a conductive material.

2. The image intensifier tube of claim 1, wherein the IBF comprises non-conductive alumina doped with the conductive material, and the conductive material comprises chromium oxide ($Cr_2O_3$).

3. The image intensifier tube of claim 1, wherein the IBF comprises alumina doped with the conductive material, and the conductive material comprises manganese oxide ($Mn_3O_4$).

4. The image intensifier tube of claim 1 wherein the IBF comprises non-conductive alumina doped with the conductive material.

5. The image intensifier tube of claim 1, wherein the IBF comprises approximately 2% of the conductive material in a layer of alumina.

6. The image intensifier tube of claim 1 wherein:

the IBF is disposed on top of the MCP, and the IBF comprises approximately 98% of the non-conductive material and approximately 2% of the conductive material.

7. The image intensifier tube of claim 1 wherein:

the IBF is disposed on top of the MCP, and the IBF comprises a layer of the conductive material deposited on top of a layer of the non-conductive material.

8. The image intensifier tube of claim 7, wherein the layer of conductive material comprises metallic aluminum.

9. An imager comprising:

a microchannel plate (MCP) including multiple channels for receiving electrons from a photocathode layer, and an ion barrier film (IBF) disposed on top of and in contact with the MCP between the MCP and the photocathode layer, wherein the IBF comprises a non-conductive material and 1% to 5% of conductive material.

10. The imager of claim 9 wherein the IBF comprises non-conductive alumina doped with the conductive material, and the conductive material comprises chromium oxide ($Cr_2O_3$).

11. The imager of claim 9 wherein the IBF comprises non-conductive alumina doped with the conductive material, and the conductive material comprises manganese oxide ($Mn_3O_4$).

12. The imager of claim 9 wherein the IBF comprises non-conductive alumina doped with the conductive material.

13. The imager of claim 9 wherein the IBF comprises approximately 2% of the conductive material in a layer of the non-conductive material, and the non-conductive material is alumina.

14. The imager of claim 9 wherein the IBF comprises approximately 98% of the non-conductive material and approximately 2% of the conductive material.

15. The imager of claim 9 wherein the IBF comprises a layer of the conductive material deposited on top of the non-conductive material.

16. The imager of claim 15 wherein the layer of conductive material is 5 to 10 Angstroms in thickness.

17. The imager of claim 9, wherein the MCP comprises multiple, non-perpendicular channels and further comprising a collimator between the IBF and the photocathode.

18. The imager of claim 9, wherein the layer of conductive material comprises metallic aluminum.

19. A method of making a microchannel plate (MCP) for an image intensifier tube, the method comprising the steps of:

forming an ion barrier film (IBF) on top of and in connect with an input side of the MCP, wherein the IBF comprises 1% to 5% of a conductive material; and positioning the IBF between the MCP and a collimator.

20. The method of claim 19 wherein the step of forming includes:

forming the IBF with non-conductive alumina, and doping the IBF with the conductive material, wherein the conductive material comprises chromium oxide ($Cr_2O_3$).

21. The method of claim 19 wherein the step of forming includes forming the IBF with non-conductive alumina, and doping the IBF with the conductive material, wherein the conductive material comprises manganese oxide ($Mn_3O_4$.

22. The method of claim 19 wherein the step of forming includes:

forming the IBF with non-conductive material, and doping the IBF with approximately 2% of the conductive material.

23. The method of claim 19 wherein the step of forming includes:

forming the IBF with non-conductive material, and depositing the conductive material in a layer 5 to 10 Angstroms in thickness on top of the non-conductive material.

24. The method of claim 23, wherein the layer of conductive material comprises metallic aluminum.

25. The method of claim 19, wherein the MCP comprises a plurality of glass fibers, each fiber comprising cladding glass, further comprising the steps of:

etching the glass fibers to form multiple channels of the MCP in which the multiple channels have walls formed by the cladding glass; and positioning the IBF between the multiple channels of the MCP and the collimator.

* * * * *